US008167178B2

(12) United States Patent
Yu

(10) Patent No.: US 8,167,178 B2
(45) Date of Patent: May 1, 2012

(54) PERFUME BOTTLE SEALING STRUCTURE

(75) Inventor: Yuan-Wen Yu, Taoyuan Hsien (TW)

(73) Assignee: Ing Wen Precision Ent. Co., Ltd., Taoyuan Hsien (TW)

( * ) Notice: Subject to any disclaimer, the term of this patent is extended or adjusted under 35 U.S.C. 154(b) by 0 days.

(21) Appl. No.: 12/004,507

(22) Filed: Dec. 21, 2007

(65) Prior Publication Data

US 2011/0253748 A1 Oct. 20, 2011

(51) Int. Cl.
*B65D 47/00* (2006.01)

(52) U.S. Cl. ..... 222/562; 222/153.1; 222/482; 222/484; 222/542; 222/367.1

(58) Field of Classification Search ..... 222/562–564, 222/542, 553, 554, 481.5, 484, 153.1, 153.01; 239/318; 220/367.1, 361, 366.1, 360
See application file for complete search history.

(56) References Cited

U.S. PATENT DOCUMENTS 3,176,883 A * 4/1965 Davis, Jr. ..... 222/633
3,187,962 A * 6/1965 Meshberg ..... 222/402.2
3,726,442 A * 4/1973 Davidson et al. ..... 222/207
4,093,124 A * 6/1978 Morane et al. ..... 239/327
4,530,466 A * 7/1985 Rounkles et al. ..... 239/327
4,917,271 A * 4/1990 Kanner et al. ..... 222/189.09
5,894,960 A * 4/1999 Rodden et al. ..... 222/207
5,967,384 A * 10/1999 Mengeu et al. ..... 222/517
5,975,381 A * 11/1999 Revenu ..... 222/563
6,513,681 B2 * 2/2003 Gross et al. ..... 222/211
6,854,612 B2 * 2/2005 Thomson ..... 215/21
7,357,335 B2 * 4/2008 Laidler et al. ..... 239/302
7,490,742 B2 * 2/2009 Yu ..... 222/183
7,559,441 B2 * 7/2009 Yu ..... 222/183
7,775,461 B2 * 8/2010 Laidler et al. ..... 239/362

* cited by examiner

*Primary Examiner* — Frederick C. Nicolas

(57) ABSTRACT

A perfume bottle sealing structure includes a cover, which is covered on the bottleneck of a perfume bottle and has an air hole and a tubular center shaft defining a longitudinal fluid passage, and a seal that is fastened to the top end of the tubular center shaft to seal the longitudinal fluid passage and the air hole during transportation of the perfume bottle and, which has a plug rod and a bottom pin respectively fitted into the longitudinal fluid passage and the air hole to seal the bottleneck when the seal is fastened to the cover.

5 Claims, 6 Drawing Sheets

PERFUME BOTTLE SEALING STRUCTURE

BACKGROUND OF THE INVENTION

1. Field of the Invention

The present invention relates to a perfume bottle and more particularly, to a perfume bottle sealing structure that seals the bottleneck of the perfume bottle to prevent leakage during transportation.

2. Description of the Related Art

A regular spray type perfume bottle is equipped with a spray nozzle. When the user presses the spray nozzle, the internal mechanism is forced to pump contained liquid perfume out of the perfume bottle through the nozzle tip of the spray nozzle. During transportation of spray type perfume bottles, contained liquid perform may leak. When a leakage occurred, the product may be rejected.

SUMMARY OF THE INVENTION

The present invention has been accomplished under the circumstances in view. It is one object of the present invention to provide a perfume bottle sealing structure, which prevents leakage of the perfume bottle during transportation, thereby maintaining the quality of the perfume bottle.

The perfume bottle sealing structure is fastened to the bottleneck of a perfume bottle to seal the passage of the bottleneck, comprising a cover and a seal. The cover is covered on the bottleneck of the perfume bottle, having an air hole and a tubular center shaft that defines a longitudinal fluid passage. The seal has a plug rod and a bottom pin respectively fitted into the longitudinal fluid passage and the air hole to seal the bottleneck.

Therefore, after covering of the cover on the bottleneck of the perfume bottle and fastening of the seal to the cover, the bottleneck of the perfume bottle is well sealed, preventing leakage.

DETAILED DESCRIPTION OF THE PREFERRED EMBODIMENT

Figure 1:
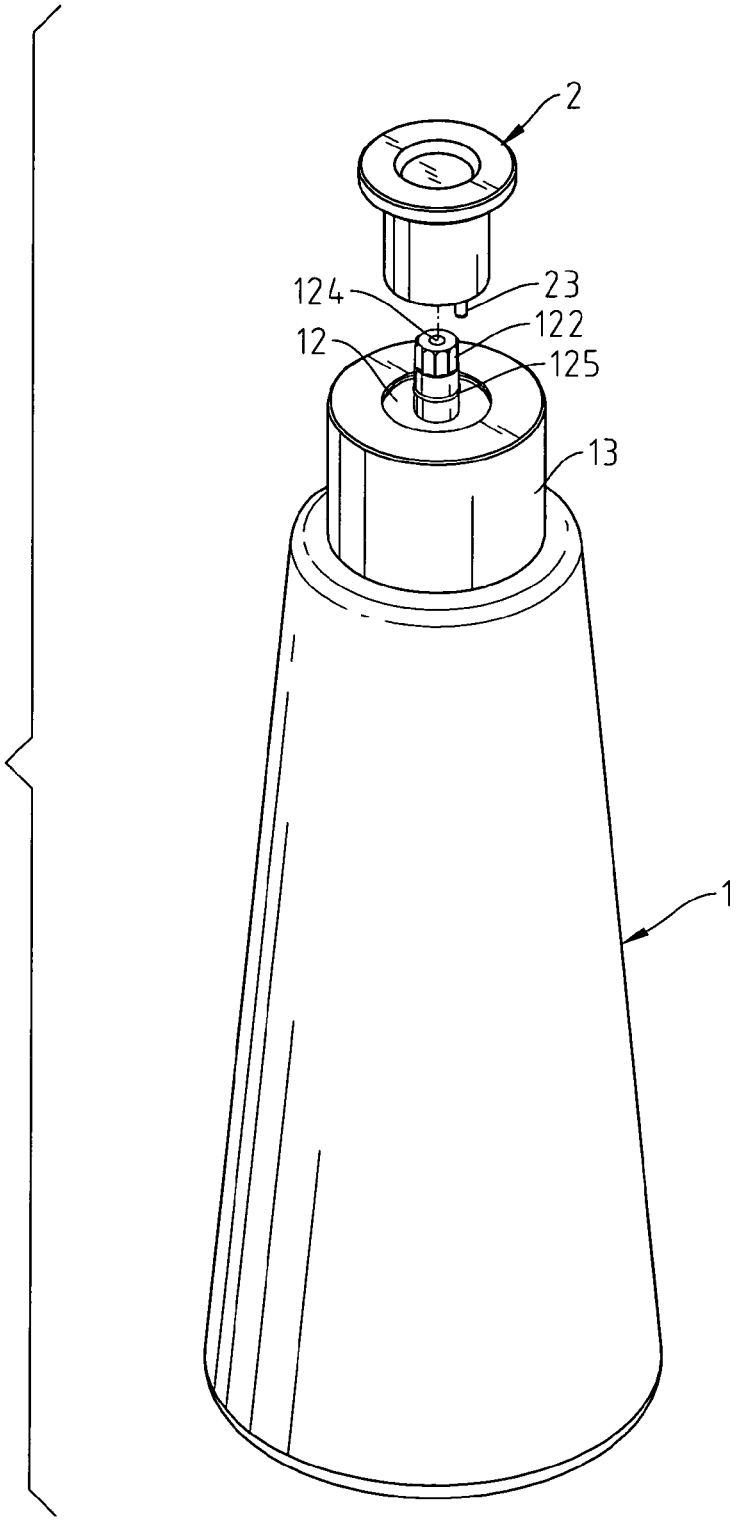
FIG. 1 is an exploded view of a perfume bottle sealing structure in accordance with the present invention.
Figure 2:
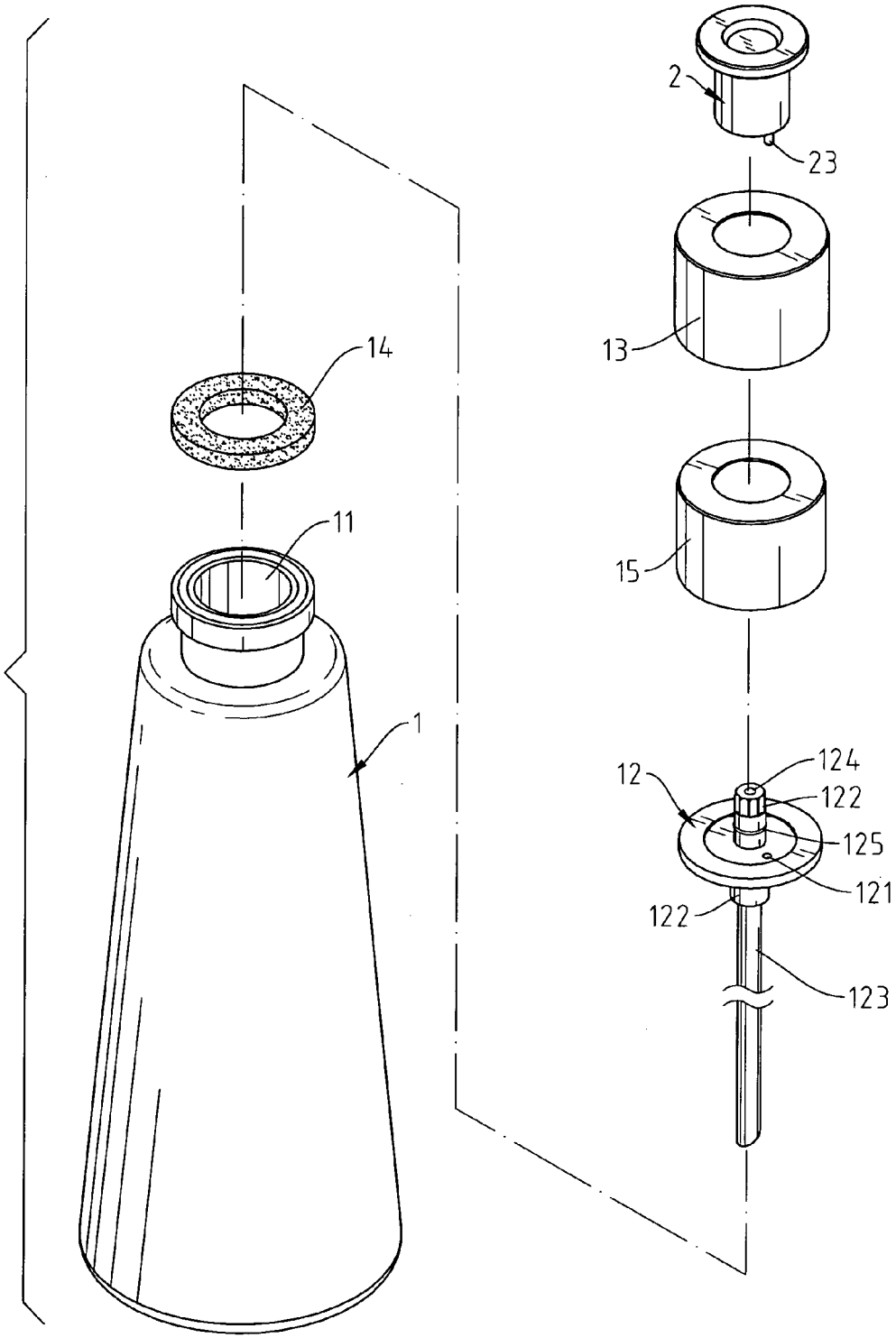
FIG. 2 is another exploded view of the perfume bottle sealing structure in accordance with the present invention.
Figure 3:
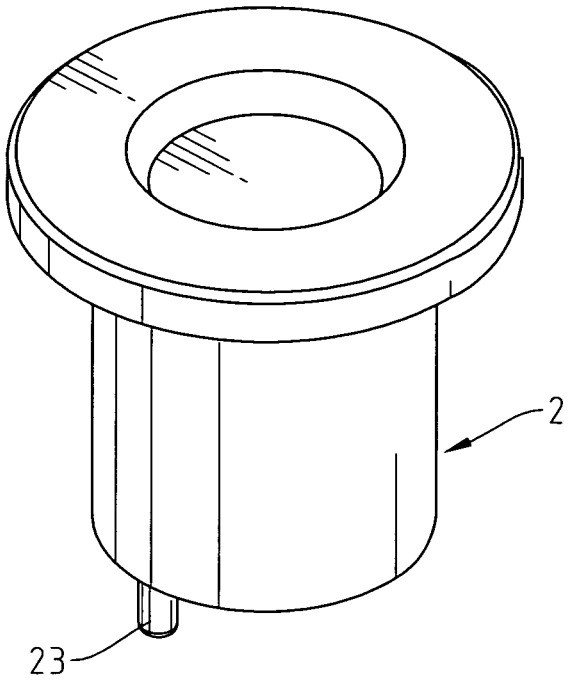
FIG. 3 is an elevational view of the seal for the perfume bottle sealing structure in accordance with the present invention.
Figure 4:
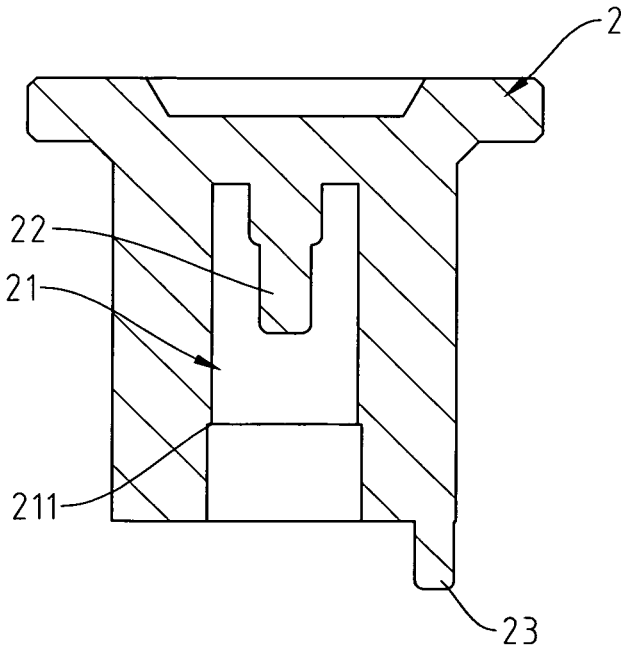
FIG. 4 is a sectional view of the seal for the perfume bottle sealing structure in accordance with the present invention.
Figure 5:
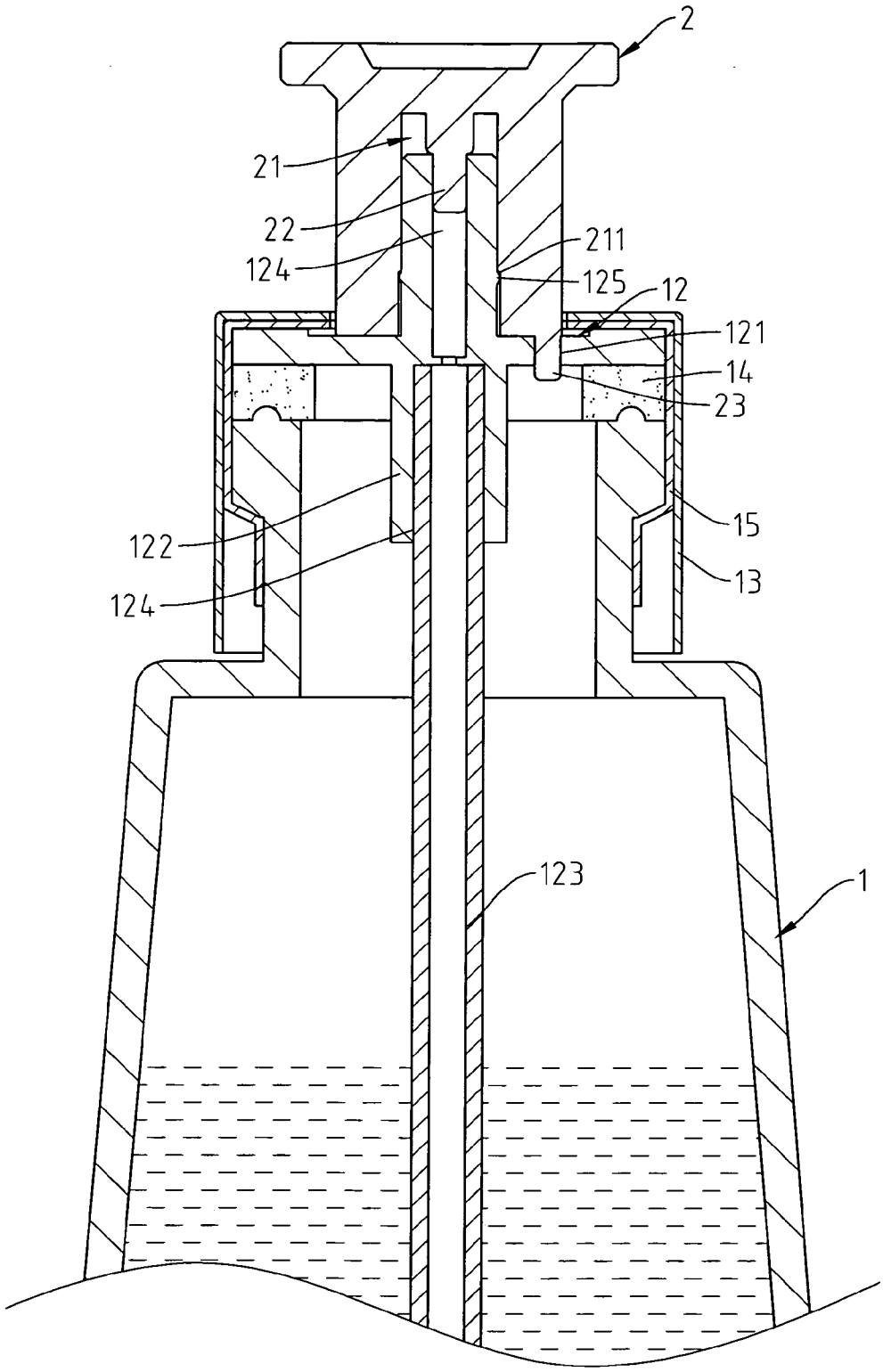
FIG. 5 is a sectional view of the present invention, showing the seal fastened to the tubular center shaft of the cover.

Referring to FIGS. 1~5, a plug 12 is mounted in the bottleneck 11 of a perfume bottle 1. A gasket ring 14 is set between the bottleneck 11 of the perfume bottle 1 and the cover 12. A metal cap 15 is capped on the bottleneck 11 of the perfume bottle 1 to hold down the cover 12 and the gasket ring 14, thereby sealing the bottleneck 11. An outer ornamental cap 13 is capped on the metal cap 15.

The cover 12 has an air hole 121, a tubular center shaft 122 that protrudes over the top and bottom walls of the cover 12 and defines a longitudinal fluid passage 124. A suction tube 123 is connected to the bottom end of the tubular center shaft 122 and dipped in the liquid perfume contained in the perfume bottle 1. The tubular center shaft 122 has an annular flange 125 extending around the periphery and spaced above the top wall of the cover 12. A seal 2 is vertically downwardly inserted through the outer ornamental cap 13 and the metal cap 15, and then fastened to the top end of the tubular center shaft 122. Further, the tubular center shaft 122 is formed integral with the cover 12 during fabrication of the cover 12.

The seal 2 has a cylindrical bottom chamber 21 that receives the top end of the tubular center shaft 122, a tapered plug rod 22 suspending in the cylindrical bottom chamber 21 and fitted into the longitudinal fluid passage 124 of the cover 12 to seal the longitudinal fluid passage 124, an inside annular groove 211 extending around the inside wall within the cylindrical bottom chamber 21 and forced into engagement with the annular flange 125 of the tubular center shaft 122 of the cover 12, and a bottom pin 23 inserted into the air hole 121 to block the passage of the air hole 121. The tapered plug rod 22 has a diameter gradually reducing toward its bottom end.

Figure 6:
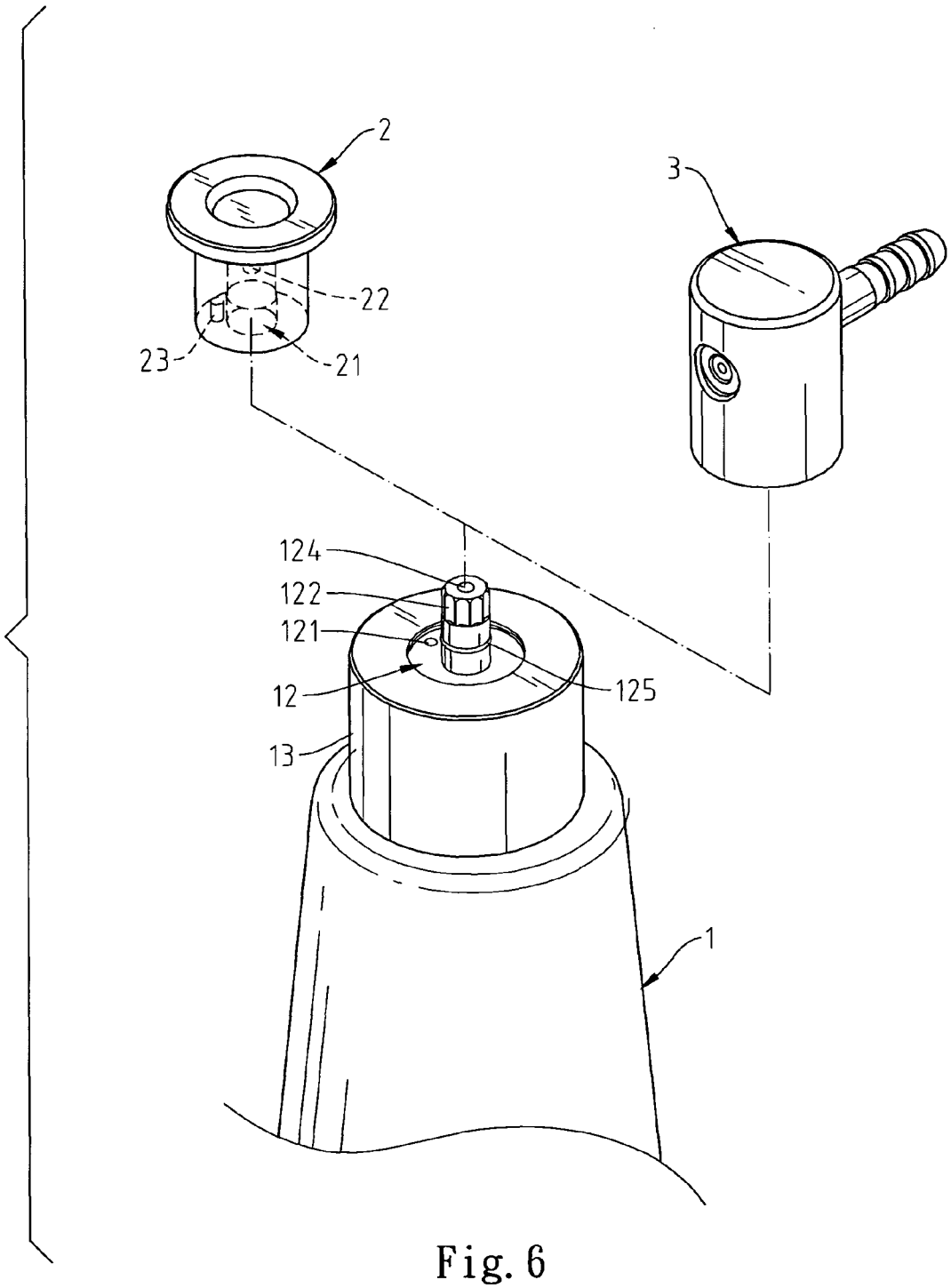
FIG. 6 is a schematic drawing of the present invention showing alternation between the seal and the spray nozzle.

Referring to FIG. 6, during transportation of the perfume bottle 1, the seal 2 is fastened to the tubular center shaft 122 of the cover 12, and therefore the bottleneck 11 of the perfume bottle 1 is well sealed, preventing leakage. Before use, the seal 2 is removed from the tubular shaft 122 of the cover 12, and a spray nozzle 3 is attached to the tubular shaft 122 of the cover 12.

Figure 7:
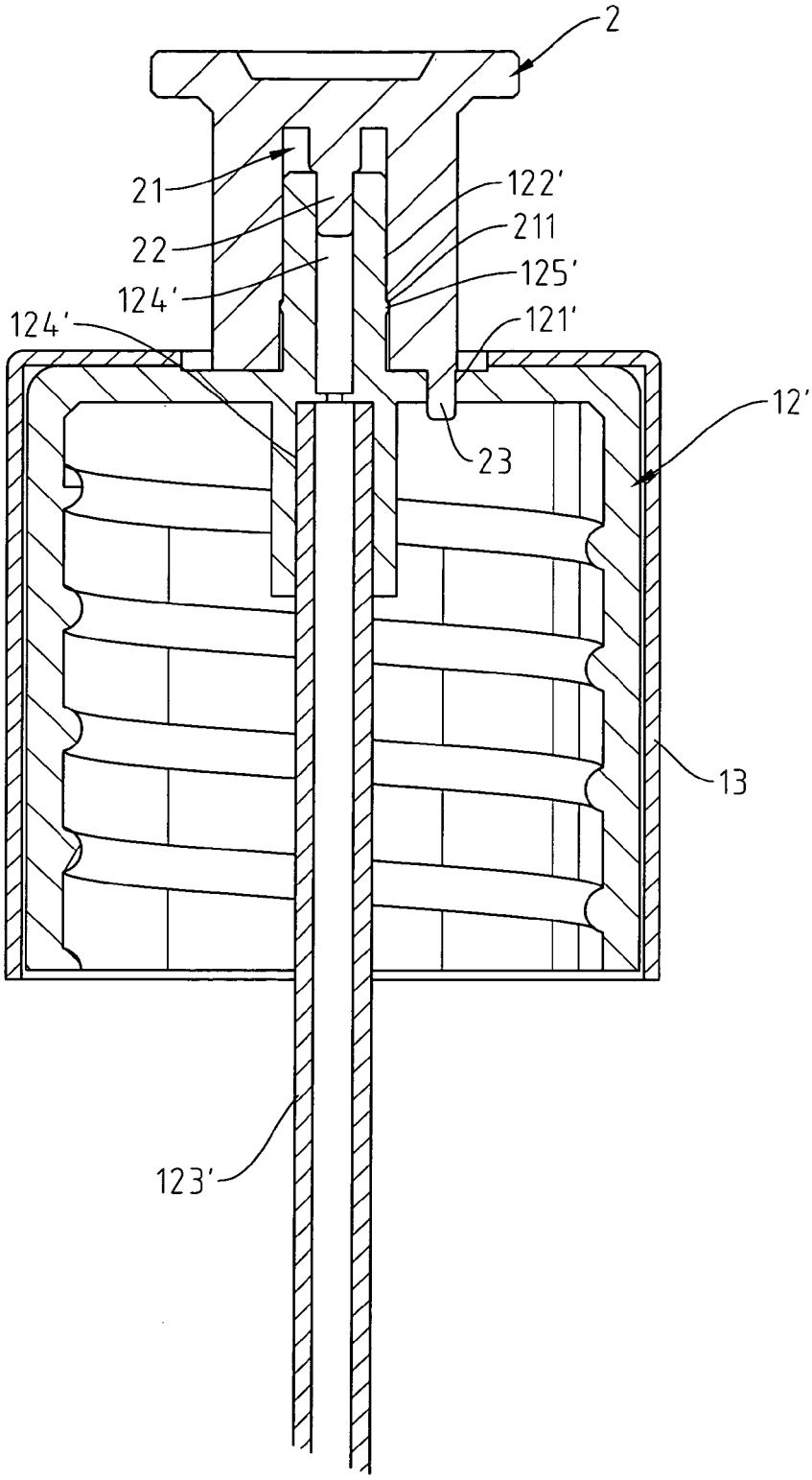
FIG. 7 is a sectional view of an alternate form of the present invention.

FIG. 7 shows an alternate form of the present invention. According to this embodiment, the cover, referenced by 12', has an air hole 121', a tubular center shaft 122' that protrudes over the top and bottom walls of the cover 12' and defines a longitudinal fluid passage 124'. A suction tube 123' is connected to the bottom end of the tubular center shaft 122'. The tubular center shaft 122' has an annular flange 125' extending around the periphery and spaced above the top wall of the cover 12'. The tubular center shaft 122' has an annular flange 125' extending around the periphery and spaced above the top wall of the cover 12'. The seal 2 is capped onto the top end of the tubular center shaft 122' to force its plug rod 22 into the longitudinal fluid passage 124' of the cover 12', its inside annular groove 211 into engagement with the annular flange 125' of the tubular center shaft 122' of the cover 12', and its bottom pin 23 into the air hole 121' of the cover 12'. According to this embodiment, the cover 12' is a screw cap for threading onto the threaded bottleneck of a perfume bottle.

Although particular embodiments of the invention have been described in detail for purposes of illustration, various modifications and enhancements may be made without departing from the spirit and scope of the invention.

What the invention claimed is:

1. A perfume bottle sealing structure fastened to a bottleneck of a perfume bottle to seal a passage of the bottleneck, comprising:

a cover covered on said bottleneck of said perfume bottle, said cover comprising an air hole cut through top and bottom walls thereof, a tubular center shaft that protrudes over the top and bottom walls of said cover, said tubular center shaft having a longitudinal fluid passage extending through top and bottom ends thereof; and a seal fastened to the top end of said tubular center shaft to seal said longitudinal fluid passage and said air hole, said seal comprising a bottom chamber, which receives the top end of said tubular center shaft, a plug rod suspended in said bottom chamber being fitted into said longitudinal fluid passage, and a bottom pin fitted into said air hole;

wherein said tubular center shaft of said cover comprises an annular flange extending around the periphery thereof and spaced above the top wall of said cover; said seal comprises an inside annular groove disposed inside said bottom chamber and forced into engagement with the annular flange of said tubular center shaft of said cover.

2. The perfume bottle sealing structure as claimed in claim 1, wherein said plug rod is a tapered rod having a diameter gradually reduced toward a bottom end thereof.

3. The perfume bottle sealing structure as claimed in claim 1, further comprises a gasket ring set between said bottleneck and said cover.

4. The perfume bottle sealing structure as claimed in claim 1, further comprising a metal cap capped onto said bottleneck to hold down said cover on said bottleneck.

5. The perfume bottle sealing structure as claimed in claim 1, wherein said tubular center shaft of said cover is formed integral with said cover.

* * * * *